US005736501A

United States Patent [19]

Yamashita et al.

[11] Patent Number: 5,736,501

[45] Date of Patent: Apr. 7, 1998

[54] METHOD FOR PRODUCING NONIONIC DETERGENT GRANULES

[75] Inventors: Hiroyuki Yamashita; Koji Toyoda; Masaaki Sakaue; Yasuji Yamada; Teruo Kubota; Hiroshi Kogurusu, all of Wakayama, Japan

[73] Assignee: Kao Corporation, Tokyo, Japan

[21] Appl. No.: 505,898

[22] Filed: Jul. 24, 1995

[30] Foreign Application Priority Data

Aug. 12, 1994 [JP] Japan ..... 6-211929

[51] Int. Cl.[6] ..... C11D 11/00

[52] U.S. Cl. ..... 510/444; 510/351; 510/356; 510/357; 510/361; 510/441; 510/443; 510/452; 510/467; 510/477; 510/505; 510/507; 510/509; 510/510; 510/511; 264/117; 264/140

[58] Field of Search ..... 252/89.1, DIG. 1, 252/174.21, 174, 530, 549; 264/117, 140; 23/313 R; 510/444, 351, 356, 357, 361, 441, 443, 452, 467, 477, 505, 507, 509, 510, 511

[56] References Cited

U.S. PATENT DOCUMENTS

| | | | |
|---|---|---|---|
| 3,907,702 | 9/1975 | Mostow | 252/370 |
| 4,473,485 | 9/1984 | Greene | 252/174.12 |
| 5,282,996 | 2/1994 | Appel et al. | 252/100 |
| 5,468,516 | 11/1995 | Yamashita et al. | 427/180 |

FOREIGN PATENT DOCUMENTS

| | | |
|---|---|---|
| 0420317 | 4/1991 | European Pat. Off. . |
| 0438320 | 7/1991 | European Pat. Off. . |
| 0507402 | 10/1992 | European Pat. Off. . |
| 0513824 | 11/1992 | European Pat. Off. . |
| 0544365 | 6/1993 | European Pat. Off. . |
| 52-030962 | 8/1977 | Japan . |
| 56-022394 | 3/1981 | Japan . |
| 60-021200 | 5/1985 | Japan . |
| 61-021997 | 5/1986 | Japan . |
| 61-085499 | 5/1986 | Japan . |
| 61-089300 | 5/1986 | Japan . |
| 62-263299 | 11/1987 | Japan . |
| 3026795 | 2/1991 | Japan . |
| 4227700 | 8/1992 | Japan . |
| 5209200 | 8/1993 | Japan . |
| 6507197 | 8/1994 | Japan . |

*Primary Examiner*—Christine Skane
*Assistant Examiner*—Lorna M. Douyon
*Attorney, Agent, or Firm*—Birch, Stewart, Kolasch & Birch, LLP

[57] ABSTRACT

The method for producing nonionic detergent granules includes the steps of (I) blending the following (i) to (iii): (i) at least one of a nonionic surfactant and an aqueous nonionic surfactant solution; (ii) an acid precursor of an anionic surfactant capable of having a lamellar orientation; (iii) at least one of an alkali builder and an alkali, porous oil-absorbing carrier, to give a mixture of detergent starting materials containing the nonionic surfactant as a main surfactant component; and (II) heating the mixture obtained in step (I) at least up to a temperature capable of neutralizing the acid precursor of the anionic surfactant in an agitating mixer, and granulating while tumbling the agitating mixer thereby increasing a bulk density, to give nonionic detergent granules having a bulk density of from 0.6 to 1.2 g/ml.

29 Claims, No Drawings

METHOD FOR PRODUCING NONIONIC DETERGENT GRANULES

BACKGROUND OF THE INVENTION

1. Field of the Invention

The present invention relates to a method for producing nonionic detergent granules. More specifically, the present invention relates to a method for producing nonionic detergent granules comprising a nonionic surfactant as a main surfactant component and having a small compositional restriction, a high bulk density, and excellent powder fluidity properties and non-caking property, and being free from exudation.

2. Discussion of the Related Art

As for a method for producing powdery detergent composition containing a nonionic surfactant, a method for producing granular detergent composition comprising the steps of preparing a nonionic surfactant in a detergent slurry, and spray-drying the resulting mixture has been proposed. However, in this method, besides having a large facility cost and large consumption of energy, the nonionic surfactant decomposes by a hot air upon drying, thereby making it likely to cause problems in the generation of contaminous materials, lowering of a nonionic surfactant content, and deterioration in the surfactant properties. In order to solve these problems, the kinds and amounts of the nonionic surfactants have to be limited (Japanese Patent Laid-Open No. 61-85499), or additives not contributing to washing performance have to be blended (Japanese Patent Laid-Open No. 56-22394).

Japanese Patent Examined Publication No. 60-21200 discloses a method comprising preparing builder base beads by using a spray-drying method, and carrying a nonionic surfactant on the builder base beads. However, in this method, since an anhydrous phosphate builder is used as a builder base, the main builder base is limited only to produce phosphorus-containing detergents, so that phosphorus-free detergents cannot be produced. Also, the process of producing the builder base beads having both a porous outer surface and internal skeleton structures is quite complicated.

Also, Japanese Patent Examined Publication No. 61-21997 discloses a method for continuously producing a granular detergent, comprising the steps of hydrating and wetting a washing active salt using an agglomeration device, stirring the wetted washing active salt in a tightly sealed container, impregnating with a nonionic or anionic surfactant, and drying it, to thereby give a granular detergent free from caking even after a long-term storage. However, in this method, since the agglomerates of the hydrated and wetted washing active salt are impregnated with a surfactant, a drying process has to follow granulation, thereby making the process complicated. Also, the proportion of the nonionic surfactant to be blended in the composition depends greatly upon the properties of the agglomerated granules. Therefore, when the proportion of the nonionic surfactant is made high, agglomerated granules having high oil-absorbing properties have to be prepared, thereby making the amount of an anhydrous detergent surfactant salt contained in the composition undesirably large. In other words, the compositional restriction of the detergent granules is large. In addition, the operation upon production such as hydration conditions and drying conditions becomes undesirably complicated.

Japanese Patent Laid-Open No. 3-26795 discloses a method for producing a granular detergent having good fluidity property, solubility, and dispersability, comprising the steps of forming zeolite agglomerates comprising a zeolite, a filler, and a water-containing binder using an agglomerate-forming device, further forming detergent agglomerates comprising the above zeolite agglomerates and surfactant-containing detergent components, and drying the detergent agglomerate. However, in order to obtain detergent agglomerates, the production steps at least comprise five steps, making the entire process quite complicated. Also, since it is essential to form agglomerates having zeolite as a main component, there arises such problems that the compositional restriction of the detergent granules is made large.

Japanese Patent Laid-Open No. 62-263299 discloses a method for producing a granular detergent composition comprising the steps of uniformly kneading a nonionic surfactant and a builder to form a solid detergent, and then disintegrating the solid detergent. However, in this method, it is difficult to obtain nonionic detergent granules having good fluidity property, and large amounts of undesirable fine particles are produced. Further, the total amount of zeolite and light sodium carbonate has to fall in the range of from 50 to 80% by weight, thereby making the compositional restriction for blending in nonionic detergent granules large. In addition, Japanese Patent Laid-Open No. 61-89300 discloses a method for producing a nonionic surfactant-containing granulated product, comprising the steps of blending a water-soluble granule powder and a silica powder, spraying a nonionic surfactant to the above mixture, and adding a zeolite or calcium carbonate powder to the resulting mixture. However, in this method, since the powder is tumbled and granulated using a drum-rotatable granulator, it is impossible to produce a nonionic surfactant-containing granulated product having a high bulk density.

Also, Japanese Patent Laid-Open No. 5-209200 discloses a method for producing a nonionic surfactant-containing granulated product, comprising the steps of agitating and blending a mixture of detergent starting materials containing a nonionic surfactant as a main surfactant component in an agitating mixer, the agitating mixer containing an agitating shaft along the center line of the inner portion, agitation impellers arranged along the agitating shaft, and a clearance formed upon rotating the agitating impellers between the agitating impellers and a wall of the agitating mixer, to thereby form a layer of the detergent starting materials adhered to the wall of the agitating mixer; and granulating the obtained mixture while increasing the bulk density of the detergent starting materials by the agitating impellers. However, since the nonionic surfactant is supported by the capillary force or the surface adsorption of the powdery starting materials, the supporting force is weak, so that sufficient adhesion of the nonionic surfactant-containing powder to the equipment upon conveying or sufficient exudation inhibition when packing the powder in a paper box container cannot be achieved. In addition, Japanese Patent Laid-Open No. 4-227700 discloses a powdery detergent prepared by spraying a nonionic surfactant to spray-dried particles containing an anionic surfactant and a soap. However, in this method, the nonionic surfactant cannot be blended in a large amount, so that exudation is undesirably likely to take place.

Also, Japanese Patent Examined Publication No. 52-30962 discloses a method for producing a powdery heavy detergent comprising the step of neutralizing a fatty acid or a nonionic surfactant-containing fatty acid with hydrated powdery sodium carbonate having a water content of not more than 20% in a temperature range of from a temperature not less than the melting point of the fatty acid to 100° C. However, since the nonionic surfactant is not contained in a large amount, detergent granules containing a nonionic surfactant as a main surfactant component cannot be produced. Therefore, detergent granules having high bulk density cannot be obtained in this method. Moreover, since builder components are not blended, the compositional restriction in the detergent becomes large.

Japanese Patent Unexamined Publication No. 6-507197 discloses that at least one of polyethylene glycols, copolymers of maleic anhydride and ethylene, nonionic surfactants, glycerol ethers, and fatty acids can be used in binders for granular composition. However, the reference simply discloses that each of the above components can be used for the granular composition, and it is silent in the teaching that an alkalizer, a fatty acid (an acid precursor of an anionic surfactant capable of having a lamella orientation), and a nonionic surfactant are combinably used. Also, it never suggests or teaches the formation of a gelated product with the nonionic surfactant and the effects achieved thereby.

SUMMARY OF THE INVENTION

Accordingly, an object of the present invention is to provide a method for producing nonionic detergent granules comprising a nonionic surfactant as a main surfactant component and having high bulk density and further having excellent powder fluidity properties and non-caking property.

As a result of intensive research, the present inventors have found that nonionic detergent granules can be produced by the steps of blending at least one of a nonionic surfactant and an aqueous nonionic surfactant solution, an acid precursor of an anionic surfactant capable of having a lamellar orientation, an alkali builder, and an alkali, porous oil-absorbing carrier used as an alkalizer, to neutralize the above acid precursor, thereby forming a gelated product containing a nonionic surfactant; and granulating using the above gelated product as a binder in an agitating mixer, while tumbling the mixture of the detergent starting materials to increase a bulk density. The present invention has been completed based on this finding.

The gist of the present invention is as follows:

(1) A method for producing nonionic detergent granules comprising the steps of:

(I) blending the following (i) to (iii):

(i) at least one of a nonionic surfactant and an aqueous nonionic surfactant solution;

(ii) an acid precursor of an anionic surfactant capable of having a lamellar orientation;

(iii) at least one of an alkali builder and an alkali, porous oil-absorbing carrier, to give a mixture of detergent starting materials containing the nonionic surfactant as a main surfactant component; and (II) heating the mixture obtained in step (I) at least up to a temperature capable of neutralizing the acid precursor of the anionic surfactant in an agitating mixer, and granulating while tumbling the agitating mixer thereby increasing a bulk density, to give nonionic detergent granules having a bulk density of from 0.6 to 1.2 g/ml;

(2) The method described in (1) above, wherein the nonionic surfactant is a polyoxyethylene alkyl ether which is an ethylene oxide adduct with an average molar number of from 5 to 15 of a linear or branched, primary or secondary alcohol having 10 to 20 carbon atoms;

(3) The method described in (1) above, wherein the aqueous nonionic surfactant solution is an aqueous solution of a polyoxyethylene alkyl ether, the polyoxyethylene alkyl ether being an ethylene oxide adduct with an average molar number of from 5 to 15 of a linear or branched, primary or secondary alcohol having 10 to 20 carbon atoms, wherein the water content of the aqueous nonionic surfactant solution is not more than 15% by weight;

(4) The method described in any one of (1) to (3) above, wherein the acid precursor of the anionic surfactant capable of having a lamellar orientation is selected from the group consisting of saturated or unsaturated fatty acids having 10 to 22 carbon atoms, alkylsulfuric acids having 10 to 22 carbon atoms, α-sulfonated fatty acids having 10 to 22 carbon atoms, and polyoxyethylene alkyl ether sulfuric acids whose alkyl moieties have 10 to 22 carbon atoms and whose ethylene oxide moieties have an average molar number of from 0.2 to 2.0;

(5) The method described in any one of (1) to (4) above, wherein the amount of the acid precursor of the anionic surfactant capable of having a lamellar orientation is from 5 to 100 parts by weight, based on 100 parts by weight of the amount of at least one of the nonionic surfactant and the aqueous nonionic surfactant solution;

(6) The method described in (1) above, wherein the alkali builder is selected from the group consisting of organic or inorganic builders, each having a pH of not less than 8 when prepared as an aqueous solution or a dispersed solution, at 20° C. with a concentration of 1 g/liter, each having an average particle size of not more than 500 μm;

(7) The method described in (6) above, wherein the alkali builder is one or more compounds selected from the group consisting of tripolyphosphates, carbonates, bicarbonates, sulfites, silicates, crystalline aluminosilicates, citrates, polyacrylates, salts of copolymers of acrylic acid and maleic acid, and polyglyoxylates, each having an average particle size of not more than 500 μm;

(8) The method described in (1) above, wherein the alkali, porous oil-absorbing carrier has the following properties:

(a) Having a pH of not less than 8 when prepared as an aqueous solution or a dispersed solution, at 20° C. with a concentration of 1 g/liter;

(b) Having a microporous capacity measured by a mercury porosimeter of from 100 to 600 $cm^3$/100 g;

(c) Having a specific surface area according to BET method of from 20 to 700 $m^2$/g; and (d) Having an oil-absorbing capacity according to JIS K 5101 of not less than 100 ml/100 g, the alkali, porous oil-absorbing carrier having an average particle size or an average primary particle size of not more than 10 μm;

(9) The method described in (8) above, wherein the alkali, porous oil-absorbing carrier is one or more compounds selected from the group consisting of amorphous aluminosilicates and calcium silicates, with an average primary particle size of not more than 10 μm;

(10) The method described in (9) above, wherein the alkali, porous oil-absorbing carrier is an amorphous aluminosilicate having a water content of 15 to 30% by weight, with an average primary particle size of not more than 0.1 μm, and an average particle size of agglomerates thereof of not more than 50 μm;

(11) The method described in (1) above, wherein step (I) is carried out by using a mixed solution obtained by mixing at least one of the nonionic surfactant and the aqueous nonionic surfactant solution with the acid precursor of the anionic surfactant capable of having a lamellar orientation; and subsequently step (II) is carried out by heating to a temperature of not less than a melting point of the obtained mixed solution;

(12) The method described in (1) above, wherein step (I) is carried out by adding at least one of the nonionic surfactant and the aqueous nonionic surfactant solution, and the acid precursor of the anionic surfactant capable of having a lamellar orientation without mixing in advance; and subsequently step (II) is carried out by heating to a temperature of not less than the highest melting point among the added compounds;

(13) The method described in (1) above, wherein at least one of a neutral or acidic builder and spray-dried particles thereof is further added at any stage in step (I);

(14) The method described in (13) above, wherein the neutral or acidic builder is selected from the group consisting of organic or inorganic builders having a pH of less than 8 when prepared as an aqueous solution or a dispersed solution, at 20° C. with a concentration of 1 g/liter;

(15) The method described in (14) above, wherein the neutral or acidic builder is one or more compounds selected from the group consisting of sodium sulfate, citric acid, polyacrylic acids, partially neutralized polyacrylic acids, copolymers of acrylic acid and maleic acid, and partially neutralized copolymers of acrylic acid and maleic acid;

(16) The method described in (13) above, wherein the spray-dried particles are particles obtained by spray-drying a water slurry containing one or more organic or inorganic builders;

(17) The method described in (16) above, wherein the spray-dried particles are particles obtained by spray-drying a slurry containing one or more compounds selected from the group consisting of carbonates, crystalline aluminosilicates, citrates, sodium sulfate, sulfites, polyacrylates, salts of copolymers of acrylic acid and maleic acid, polyglyoxylates, anionic surfactants, nonionic surfactants, and fluorescent dyes;

(18) The method described in (1) or (13) above, wherein the amount of the detergent starting materials used in step (I) is selected from the following composition (a) or (b):

(a) 10 to 60 parts by weight in a total amount of at least one of the nonionic surfactant and the aqueous nonionic surfactant solution, and the acid precursor of the anionic surfactant capable of having a lamellar orientation; 40 to 90 parts by weight of at least one of the alkali builder and the alkali, porous oil-absorbing carrier; and 0 to 10 parts by weight of the neutral or acidic builder;

(b) 10 to 60 parts by weight in a total amount of at least one of the nonionic surfactant and the aqueous nonionic surfactant solution, and the acid precursor of the anionic surfactant capable of having a lamellar orientation; 10 to 80 parts by weight of at least one of the alkali builder and the alkali, porous oil-absorbing carrier; 0 to 10 parts by weight of the neutral or acidic 10 builder; and 10 to 80 parts by weight of the spray-dried particles;

(19) The method described in (1), (11), or (12) above, wherein step (II) is carried out using an agitating mixer equipped with a jacket capable of flowing warm water therein, the temperature of the warm water flowing in the jacket being set at a temperature higher than (A) or (B) defined below:

(A) A melting point of the following mixed solution, in a case where step (I) is carried out by using a mixed solution obtained by mixing at least one of the nonionic surfactant and the aqueous nonionic surfactant solution with the acid precursor of the anionic surfactant capable of having a lamellar orientation;

(B) A melting point of the following compound having the highest melting point among the following components, in a case where step (I) is carried out by adding at least one of the nonionic surfactant and the aqueous nonionic surfactant solution, and the acid precursor of the anionic surfactant capable of having a lamella orientation without mixing in advance;

(20) The method described in (19) above, wherein the granulation process of step (II) is carried out in an agitating mixer comprising an agitating shaft along a center line of the horizontal cylinder and agitating impellers arranged on the agitating shaft;

(21) The method described in (20) above, wherein the granulation process is carried out under the condition of a Froude number of from 1 to 4, based on the rotation of the agitating impellers arranged in the agitating mixer used in step (II);

(22) The method described in any one of (19) to (21) above, wherein the granulation process in step (II) is carried out for 2 to 20 minutes;

(23) The method described in (1) above, wherein step (I) and step (II) are carried out in the same mixer;

(24) The method described in any one of (1) to (23) above, further comprising mixing the granulated product obtained in step (II) and fine powder, to thereby coat surfaces of the granulated product with fine powder;

(25) The method described in (24) above, wherein the fine powder has an average primary particle size of not more than 10 μm, and wherein the amount of the fine powder used is from 0.5 to 20 parts by weight, based on 100 parts by weight of the granulated product;

(26) The method described in (25) above, wherein the fine powder is one or more compounds selected from the group consisting of crystalline or amorphous aluminosilicates, and calcium silicates;

(27) The method described in (1) above, wherein the obtainable nonionic detergent granules have an average particle size of from 250 to 800 μm;

(28) The method described in (1) above, wherein the obtainable nonionic detergent granules have a fluidity property with a flow time of not more than 10 seconds, the flow time being a time period required for dropping 100 ml of powder from a hopper used in a measurement of bulk density according to JIS K 3362; and

(29) The method described in (1) above, wherein the obtainable nonionic detergent granules have a caking property with a sieve permeability of not less than 90%.

DETAILED DESCRIPTION OF THE INVENTION

The present invention will be explained in detail below.

The method for producing nonionic detergent granules of the present invention comprises the step (I) and step (II), each of the steps being explained in detail below.

Step (I)

In the method of the present invention, step (I) comprises blending the following (i) to (iii):

(i) at least one of a nonionic surfactant and an aqueous nonionic surfactant solution;

(ii) an acid precursor of an anionic surfactant capable of having a lamellar orientation.

Although the nonionic surfactants usable in the present invention are not particularly limited, those in the form of liquid or paste at 40° C. and having an HLB in the range of from 9.0 to 16.0 are suitably used because of their excellent stain-removing property, foaming property, and foam breaking property. The HLB referred herein is defined in the reference given below. Specifically, HLB is defined by W. C.

Griffin in *Kirk-Oth-mer Encyclopedia of Chemical Technology*, Third Ed. (M. Grayson ed.), Vol. 8, pp. 900–980, Published by Weily Interscience, New York 1979.

Examples of the nonionic surfactants used as a main surfactant components include polyoxyethylene alkyl ethers and polyoxyethylene alkylphenyl ethers, with a preference given to polyoxyethylene alkyl ethers which are ethylene oxide adducts with an average molar number of from 5 to 15, preferably from 6 to 12, more preferably from 6 to 10, of a linear or branched, primary or secondary alcohol having 10 to 20 carbon atoms, preferably 10 to 15 carbon atoms, more preferably 12 to 14. Also, the above polyoxyethylene alkyl ethers generally contain a large amount of ethylene oxide adducts with a low molar number, with a preference given to the ethylene oxide adducts having a 0 to 3 molar number in an amount of from not more than 35% by weight, preferably not more than 25% by weight. Besides the ones mentioned above, polyoxyethylene sorbitan fatty acid esters, polyoxyethylene sorbitol fatty acid esters, polyoxyethylene glycol fatty acid esters, polyoxyethylene polyoxypropylene alkyl ethers, polyoxyethylene castor oils, polyoxyethylene hardened castor oils, polyoxyethylene alkyl amines, glycerol fatty acid esters, higher fatty acid alkanol amides, alkyl glycosides, and alkyl amine oxides, may be added in suitable amounts.

The nonionic surfactants in a liquid state at an ambient temperature may be blended without further treatment, or they may be blended in a state of an aqueous solution, namely an aqueous nonionic surfactant solution. In addition, both the nonionic surfactant and the aqueous nonionic surfactant solution may be blended in the detergent composition. By using the nonionic surfactant in a state of an aqueous nonionic surfactant solution, the neutralization reaction of at least one of the alkali builder and the alkali, porous oil-absorbing carrier, with the acid precursor of the anionic surfactant capable of having a lamellar orientation is effectively progressed. The nonionic surfactants used in preparing an aqueous solution thereof may be the same materials mentioned above. Specifically, among the aqueous nonionic surfactant solutions, a preference is given to aqueous solutions of polyoxyethylene alkyl ethers, the polyoxyethylene alkyl ethers being ethylene oxide adducts with an average molar number of from 5 to 15, preferably from 6 to 12, more preferably from 6 to 10, of a linear or branched, primary or secondary alcohol having 10 to 20 carbon atoms, preferably 10 to 15 carbon atoms, more preferably 12 to 14.

The water content of the aqueous nonionic surfactant solution is not more than 15% by weight, preferably not more than 10% by weight, particularly not more than 8% by weight. From the viewpoint of preventing the crystallization of the mixture and the production of a high-viscosity mixture, the water content is preferably not more than 15% by weight.

Examples of the acid precursors of anionic surfactants capable of having a lamellar orientation include those having the properties given in (a) or (b):

(a) An acid precursor of an anionic surfactant, characterized in that a mixture obtained as follows observed by a polarized microscope shows an anisotropic property, the mixture prepared by blending the acid precursor of an anionic surfactant with at least one of a nonionic surfactant and an aqueous nonionic surfactant solution, and neutralizing the above components with sodium carbonate.

The method of confirming the anisotropic property is as follows. Eighty parts by weight of a nonionic surfactant, 20 parts by weight of an acid precursor of an anionic surfactant used for confirming an anisotropic property, a sodium carbonate powder (average particle size: about 5 μm) in a sufficient amount for neutralizing the acid precursor are thoroughly blended by a high-speed shear mixer (homogenizer) at a temperature not less than the melting point of the above acid precursor, to thereby neutralize the components. After a sample taken from the above mixture is heated to the melting point of the acid precursor, the sample is cooled to 40° C. While keeping the temperature at 40° C., an observation is made by using a polarized microscope ("OPTIPHOT-POL," manufactured by Nikon Corporation).

(b) An acid precursor of an anionic surfactant, characterized in that a mixture obtained as follows analyzed by an X-ray diffraction method shows a lamellar-oriented peaks, the mixture prepared by blending an acid precursor of an anionic surfactant with at least one of a nonionic surfactant and an aqueous nonionic surfactant solution, and neutralizing the above components with sodium carbonate.

The X-ray diffraction method is carried out as follows. A sample comprising at least one of a nonionic surfactant and an aqueous nonionic surfactant solution and an acid precursor of an anionic surfactant in a weight ratio of from 80/20 to 20/80 is prepared. The sample is subject to a measurement using a Rigaku RAD System (X-ray source: Cu (Kα; $\lambda$=1.5405); measurement range: $2\theta$=2° to 30°).

Although the acid precursors of anionic surfactants capable of having a lamellar orientation usable in the present invention are not particularly limited, examples thereof include saturated or unsaturated fatty acids having 10 to 22 carbon atoms, preferably saturated or unsaturated fatty acids having 12 to 18 carbon atoms; alkylsulfuric acids having 10 to 22 carbon atoms, preferably alkylsulfuric acids having 12 to 14 carbon atoms; α-sulfonated fatty acids having 10 to 22 carbon atoms, preferably α-sulfonated fatty acids having 14 to 16 carbon atoms; and polyoxyethylene alkyl ether sulfuric acids whose alkyl moieties have 10 to 22 carbon atoms and whose ethylene oxide moieties have an average additional molar number of from 0.2 to 2.0, preferably polyoxyethylene alkyl ether sulfuric acids whose alkyl moieties have 12 to 14 carbon atoms and whose ethylene oxide moieties have an average additional molar number of from 0.5 to 1.5. As for the number of carbon atoms in the above compounds, from the viewpoint of detergency power and odor, a preference is given to those compounds having not less than 10 carbon atoms, and from the viewpoint of detergency power and solubility, a preference is given to those compounds having not more than 22 carbon atoms.

The acid precursors used in the present invention are preferably fatty acids. Specifically, the acid precursor may be one or more compounds selected from the group consisting of saturated fatty acids, such as capric acid, lauric acid, myristic acid, palmitic acid, and stearic acid; and unsaturated fatty acids, such as oleic acid. Particularly, a preference is given to saturated fatty acids, such as myristic acid (for instance, "LUNAC MY-98," manufactured by Kao Corporation) and palmitic acid (for instance, "LUNAC P-95," manufactured by Kao Corporation).

In addition, the amount of the acid precursor of the anionic surfactant capable of having a lamellar orientation is from 5 to 100 parts by weight, preferably 10 to 60 parts by weight, particularly 15 to 50 parts by weight, based on 100 parts by weight of at least one of the nonionic surfactant and the aqueous nonionic surfactant solution. From the viewpoint of forming a gelated product, the amount of the acid precursor is preferably not less than 5 parts by weight, and from the viewpoint of preventing the mixture from having a poor solubility, the amount of the acid precursor is preferably not more than 100 parts by weight.

In the present invention, at least one of the alkali builder and the alkali, porous oil-absorbing carrier is used as an alkalizer. Here, the alkali builder refers to one or more organic or inorganic builders having a pH of not less than 8 when prepared as an aqueous solution or a dispersed solution, at 20° C. with a concentration of 1 g/liter.

Examples of the alkali, organic builders preferably include citrates, polyacrylates, salts of copolymers of acrylic acid and maleic acid, and polyglyoxylates, with a particular preference given to trisodium citrate, sodium polyacrylates, sodium salts of copolymers of acrylic acid and maleic acid, sodium polyglyoxylates, each having an average particle size of not more than 500 μm. These organic builders may be singly used or in a mixture of two or more compounds. The average particle size is measured by one of the following methods. In the case where the average particle size of the builder is not less than 100 μm, each of standard sieves according to JIS Z 8801 is vibrated for 5 minutes, a weight percentage depending upon the size openings of the sieves is calculated. In the case where the average particle size is less than 100 μm, a method utilizing light scattering, for instance, by using "PARTICLE ANALYSER" (manufactured by Horiba, Ltd.) may be used for measuring the average particle size.

Next, examples of the alkali, inorganic builders include carbonates, bicarbonates, sulfites, silicates, tripolyphosphates and other phosphates, crystalline aluminosilicates and amorphous aluminosilicates. Specifically, examples thereof include alkali salts, such as sodium carbonate, potassium carbonate, sodium bicarbonate, sodium sulfite, sodium sesquicarbonate, sodium silicate (JIS No. 1 or No.2 Sodium Silicate); crystalline silicate compounds having ion exchange capacity of not less than 100 $CaCO_3$ mg/g; phosphates (alkali metal salts such as sodium salts and potassium salts thereof), including orthophosphates, pyrophosphates, tripolyphosphates, metaphosphates, hexametaphosphates, and phytic acid; and crystalline and amorphous sodium aluminosilicates.

Among the above alkali, inorganic builders, a greater preference is given to one or more compounds selected from the group consisting of sodium tripolyphosphate, sodium carbonate, sodium bicarbonate, sodium sulfite, sodium aluminosilicates, and crystalline silicate compounds having ion exchange capacity of not less than 100 $CaCO_3$ mg/g, each having an average particle size of not more than 500 μm, particularly not more than 350 μm. The average particle size of the inorganic builder may be obtained by the same measurement technique as that for the organic builder mentioned above. In addition, these organic builders and inorganic builders may be used in combination.

The alkali, porous oil-absorbing carrier in the present invention has the following properties:

(a) Having a pH of not less than 8 when prepared as an aqueous solution or a dispersed solution, at 20° C. with a concentration of 1 g/liter;

(b) Having a microporous capacity measured by a mercury porosimeter of from 100 to 600 $cm^3$/100 g;

(c) Having a specific surface area according to BET method of from 20 to 700 $m^2$/g; and (d) Having an oil-absorbing capacity according to JIS K 5101 of not less than 100 ml/100 g, preferably not less than 150 ml/100 g, the porous oil-absorbing carrier having an average particle size or an average primary particle size of not more than 10 μm. The average particle size of the alkali, porous oil-absorbing carrier may be obtained by the same measurement technique as that for the builders mentioned above. Examples of the porous oil-absorbing carriers include the following:

1) Amorphous aluminosilicate salts

Examples of compounds having amorphous aluminosilicate salts as a main component thereof include "ALUMINUM SILICATE P820," (manufactured by Degussa AG) and "TIXOLEX 25," (manufactured by KOFRAN CHEMICAL Co., Ltd.), with a preference given to those having the following general formula can be suitably used.

$$x(M_2O)\cdot Al_2O_3\cdot y(SiO_2)\cdot w(H_2O), \quad (1)$$

wherein M represents an alkali metal atom, such as a sodium atom or a potassium atom; x, y, and w represent molar numbers of each of the components, which generally fall in the following ranges:

$0.2 \leqq x \leqq 2.0$;

$0.5 \leqq y \leqq 10.0$; and w is an arbitrary number of zero (0) or higher.

$$x(MeO)\cdot y(M_2O)\cdot Al_2O_3\cdot z(SiO_2)\cdot w(H_2O), \quad (2)$$

wherein Me represents an alkaline earth metal atom, such as a calcium atom or a magnesium atom; M represents an alkali metal atom, such as a sodium atom or a potassium atom; x, y, z, and w represent molar numbers of each of the components, which generally fall in the following ranges:

$0.001 \leqq x \leqq 0.1$;

$0.2 \leqq y \leqq 2.0$;

$0.5 \leqq z \leqq 10.0$; and w is an arbitrary number of zero (0) or higher.

These amorphous aluminosilicate salts in (1) and (2) above have ion exchange capacity.

2) Calcium silicates

Examples of sodium silicates include "FLORITE R" (manufactured by Tokuyama Soda Co., Ltd.) and "HUBERSORB™ 600" (manufactured by J. M. Huber Corporation).

Among the above porous oil-absorbing carriers, a preference is given to amorphous aluminosilicates having a water content of from 15 to 30% by weight, because the neutralization reaction with fatty acids can be favorably progressed. Further, these amorphous aluminosilicates preferably have an average primary particle size of not more than 0.1 μm, and agglomerates thereof preferably have an average particle size of not more than 50 μm.

Also, in step (I), at least one of a neutral or acidic builder and spray-dried particles are added to the components at any stage. By adding the neutral or acidic builder and spray-dried particles, the solubility and the washing performance can be further improved. Further, the spray-dried particles are used for the purposes of controlling bulk density and increasing the amount of oil absorbed in the builder.

The above neutral or acidic builders usable in the present invention may be one or more organic or inorganic builders having a pH of less than 8 when prepared as an aqueous solution or a dispersed solution, at 20° C. with a concentration of 1 g/liter.

Specifically, examples of the neutral or acidic builders include one or more compounds selected from the group consisting of sodium sulfate, sodium chloride, citric acid, polyacrylic acids, partially neutralized polyacrylic acids, copolymers of acrylic acid and maleic acid, partially neutralized copolymers of acrylic acid and maleic acid, and non-dissociating polymers, such as polyethylene glycols, polyvinyl alcohols, polyvinyl pyrrolidones, carboxymethyl cellulose, and cold water-soluble urethanated polyvinyl alcohols. Among them, a preference is given to those having an average particle size of not more than 500 μm, more preferably not more than 350 μm. Among them, a particular preference is given to one or more compounds selected from the group consisting of sodium sulfate, citric acid, polyacrylic acids, partially neutralized polyacrylic acids, copolymers of acrylic acid and maleic acid, and partially neutralized copolymers of acrylic acid and maleic acid.

The spray-dried particles may be particles obtained by spray-drying by a known method a slurry containing one or more inorganic or organic builders mentioned above. Among them, a preference is given to particles obtained by spray-drying a slurry containing one or more compounds selected from the group consisting of tripolyphosphates, carbonates, crystalline or amorphous aluminosilicates, citrates, sodium sulfate, sulfites, polyacrylates, salts of copolymers of acrylic acid and maleic acid, polyglyoxylates, non-dissociating polymers, such as polyethylene glycols, polyvinyl alcohols, polyvinyl pyrrolidones, carboxymethyl cellulose, and cold water-soluble urethanated polyvinyl alcohols, anionic surfactants, nonionic surfactants, and fluorescent dyes. Moreover, a particular preference is given to particles obtained by spray-drying a slurry containing one or more compounds selected from the group consisting of carbonates such as sodium carbonate, crystalline aluminosilicates, citrates, sodium sulfate, sulfites such as sodium sulfite, polyacrylates such as sodium polyacrylates, salts of copolymers of acrylic acid and maleic acid, such as sodium salts of copolymers of acrylic acid and maleic acid, polyglyoxylates such as sodium polyglyoxylates, anionic surfactants, nonionic surfactants, and fluorescent dyes. Here, the spray-dried particles preferably have an average particle size of from 100 to 600 μm, particularly of from 150 to 400 μm.

Also, the water content of the water slurry is preferably from 30 to 80% by weight, more preferably from 35 to 60% by weight. In the production of the spray-dried particles, one or more of anionic surfactants, cationic surfactants, and nonionic surfactants may be optionally added up to an amount of 40% by weight to the spray-dried particles, and other additives may be added in an amount of not more than 5% by weight.

By blending each of the components in step (I) with a composition selected from (a) or (b) given below, the detergent starting material mixture having a nonionic surfactant as a main surfactant component can be prepared.

(a) 10 to 60 parts by weight, preferably from 15 to 50 parts by weight, particularly 20 to 40 parts by weight, in a total amount of at least one of the nonionic surfactant and the aqueous nonionic surfactant solution, and the acid precursor of the anionic surfactant capable of having a lamellar orientation; 40 to 90 parts by weight, preferably from 50 to 85 parts by weight, particularly 60 to 80 parts by weight, of at least one of the alkali builder and the alkali, porous oil-absorbing carrier; and 0 to 10 parts by weight, preferably 0 to 5 parts by weight, of the neutral or acidic builder.

(b) 10 to 60 parts by weight, preferably from 15 to 50 parts by weight, particularly 20 to 40 parts by weight, in a total amount of at least one of the nonionic surfactant and the aqueous nonionic surfactant solution, and the acid precursor of the anionic surfactant capable of having a lamellar orientation; 10 to 80 parts by weight, preferably from 15 to 70 parts by weight, particularly 20 to 60 parts by weight, of at least one of the alkali builder and the alkali, porous oil-absorbing carrier; 0 to 10 parts by weight, preferably 0 to 5 parts by weight, of the neutral or acidic builder; and 10 to 80 parts by weight, preferably from 15 to 70 parts by weight, particularly 20 to 60 parts by weight, of spray-dried particles.

The blending methods employed in step (I) are not particularly limited. In the case where the present invention is carried by a batch process, various methods exemplified by (A) to (C) below may be employed. In the explanation of the blending methods in step (I) given below, at least one of alkali builders and alkali, porous oil-absorbing carriers, and at least one of neutral or acidic builders and spray-dried particles are collectively referred to as "builder components."

(A) Blending methods comprising the steps of preparing a mixed solution of at least one of a nonionic surfactant and an aqueous nonionic surfactant solution with an acid precursor of an anionic surfactant capable of having a lamellar orientation, and then blending the mixed solution with the builder components by various methods may be exemplified by one of the following blending methods (1) to (4). At this time, the blending may be more preferably carried out by heating the temperature of the mixer to a temperature of not lower than the melting point of the mixed solution.

(1) A blending method comprising the steps of supplying each of builder components (builder components not being blended in advance) in a mixer in advance; and then adding the mixed solution of at least one of a nonionic surfactant and an aqueous nonionic surfactant solution, and an acid precursor of an anionic surfactant capable of having a lamellar orientation.

(2) A blending method comprising the steps of supplying builder components blended in advance in a mixer; and then adding the mixed solution of at least one of a nonionic surfactant and an aqueous nonionic surfactant solution, and an acid precursor of an anionic surfactant capable of having a lamellar orientation.

(3) A blending method comprising the step of simultaneously supplying in a mixer in small amounts at a time of each of builder components (builder components not being blended in advance) and the mixed solution, the mixed solution being of at least one of a nonionic surfactant and an aqueous nonionic surfactant solution, and an acid precursor of an anionic surfactant capable of having a lamellar orientation.

(4) A blending method comprising the steps of supplying a part of builder components (builder components not being blended in advance) in a mixer in advance; and then simultaneously supplying in a mixer in small amounts at a time of the remaining builder components (builder components not being blended in advance) and the mixed solution, the mixed solution being of at least one of a nonionic surfactant and an aqueous nonionic surfactant solution, and an acid precursor of an anionic surfactant capable of having a lamellar orientation.

Among the above blending methods (1) to (4), a preference is given to a method comprising the steps of supplying each of builder components (builder components not being blended in advance) in a mixer in advance; and then adding the mixed solution of at least one of a nonionic surfactant and an aqueous nonionic surfactant solution, and an acid precursor of an anionic surfactant capable of having a lamellar orientation.

Incidentally, the mixers and the blending methods employed for the preparation of the mixed solution of at least one of a nonionic surfactant and an aqueous nonionic surfactant solution, and an acid precursor of an anionic surfactant capable of having a lamellar orientation are not particularly limited, and any of generally known mixers and blending methods may be employed. At this time, the mixed solution may be preferably prepared by heating to a temperature not lower than the melting point of the nonionic surfactant or than that of the above acid precursor.

(B) Blending methods comprising the steps of blending at least one of a nonionic surfactant and an aqueous nonionic surfactant solution with builder components in advance, and then adding the above acid precursor to the above mixture by various methods may be exemplified by one of the following blending methods (1) to (4). At this time, the blending may be more preferably carried out by heating the temperature of the mixer to a temperature of not lower than the melting point of the higher one among the nonionic surfactant and the above acid precursor.

(1) A blending method comprising the steps of supplying each of builder components (builder components not being blended in advance) in a mixer in advance; adding at least one of a nonionic surfactant and an aqueous nonionic surfactant solution to the builder components; and then adding the above acid precursor to the above mixture.

(2) A blending method comprising the steps of supplying each of builder components blended in advance in a mixer; adding at least one of a nonionic surfactant and an aqueous nonionic surfactant solution to the builder components; and then adding the above acid precursor to the above mixture.

(3) A blending method comprising the steps of simultaneously supplying in a mixer in small amounts at a time of each of builder components (builder components not being blended in advance) and at least one of a nonionic surfactant and an aqueous nonionic surfactant solution; and then adding the above acid precursor to the above mixture.

(4) A blending method comprising the steps of supplying a part of builder components (builder components not being blended in advance) in a mixer in advance; simultaneously supplying in a mixer in small amounts at a time of the remaining builder components (builder components not being blended in advance) and at least one of a nonionic surfactant and an aqueous nonionic surfactant solution; and then adding the above acid precursor to the above mixture.

(C) Blending methods comprising the steps of adding and blending simultaneously at least one of a nonionic surfactant and an aqueous nonionic surfactant solution, and the above acid precursor with builder components by various methods may be exemplified by one of the following blending methods (1) to (4). At this time, the blending may be more preferably carried out by heating the temperature of the mixer to a temperature of not lower than the melting point of the higher one among the nonionic surfactant and the above acid precursor.

(1) A blending method comprising the steps of supplying each of builder components (builder components not being blended in advance) in a mixer in advance; and then simultaneously adding at least one of a nonionic surfactant and an aqueous nonionic surfactant solution, and the above acid precursor to the builder components.

(2) A blending method comprising the steps of supplying each of builder components blended in advance in a mixer; and then simultaneously adding at least one of a nonionic surfactant and an aqueous nonionic surfactant solution, and the above acid precursor to the builder components.

(3) A blending method comprising the step of simultaneously supplying in a mixer, in small amounts at a time, builder components (builder components not being blended in advance), at least one of a nonionic surfactant and an aqueous nonionic surfactant solution, and the above acid precursor.

(4) A blending method comprising the steps of supplying a part of builder components (builder components not being blended in advance) in a mixer in advance; and simultaneously supplying in a mixer, in small amounts at a time, the remaining builder components (builder components not being blended in advance), at least one of a nonionic surfactant and an aqueous nonionic surfactant solution, and the above acid precursor.

Also, in the case where the present invention is carried out by a continuous process, the detergent starting materials are first blended or simultaneously blended and granulated by a continuous process, and the methods for supplying the detergent starting materials are not particularly limited. For instance, various methods exemplified by (1) to (5) given below may be employed.

(1) A method for continuously supplying each of the constituting components for the detergent starting materials without mixing in advance.

(2) A method for continuously supplying detergent starting materials comprising (a) a mixture of builder components blended in advance, and (b) a mixed solution of at least one of a nonionic surfactant and an aqueous nonionic surfactant solution, and an acid precursor of an anionic surfactant capable of having a lamellar orientation.

(3) A method for continuously supplying detergent starting materials comprising (a) a mixture of builder components blended in advance, (b) at least one of a nonionic surfactant and an aqueous nonionic surfactant solution, and (c) an acid precursor of an anionic surfactant capable of having a lamellar orientation.

(4) A method for continuously supplying detergent starting materials comprising (a) a mixture of two or more constituents of builder components blended in advance, the remaining builder components, and (c) a mixed solution of at least one of a nonionic surfactant and an aqueous nonionic surfactant solution, and an acid precursor of an anionic surfactant capable of having a lamellar orientation.

(5) A method for continuously supplying detergent starting materials comprising (a) a mixture of two or more constituents of builder components blended in advance, (b) the remaining builder components, (c) at least one of a nonionic surfactant and an aqueous nonionic surfactant solution, and (d) an acid precursor of an anionic surfactant capable of having a lamellar orientation.

Among the above supplying methods, the methods (2) to (5) are particularly useful for builder components having such powder properties poor in fluidity and caking property.

Alternatively, in the present invention, in the case where the detergent starting materials are continuously granulated, in another embodiment, after at least one of a nonionic surfactant and an aqueous nonionic surfactant solution, an acid precursor of an anionic surfactant capable of having a lamellar orientation, and builder components are blended together in advance by a batch process, the resulting mixture may be continuously supplied in the granulation process. Also, in cases of both the batch process and the continuous process, the liquid components, namely, at least one of a nonionic surfactant and an aqueous nonionic surfactant solution; an acid precursor of an anionic surfactant capable of having a lamellar orientation; and a mixed solution of at least one of a nonionic surfactant and an aqueous nonionic surfactant solution, and an acid precursor of an anionic surfactant capable of having a lamellar orientation may be preferably supplied by spraying.

Examples of devices preferably used for step (I) in the present invention include the following. In the case where the method of the present invention is carried out by a batch process, the devices of (1) to (4) are preferable.

(1) A mixer containing an agitating shaft in the inner portion of a blending vessel and agitating impellers on the agitating shaft, to carry out blending of the components. Specific examples include Henschel Mixer (manufactured by Mitsui Miike Machinery Co., Ltd.).; High-Speed Mixer (Fukae Powtec Corp.); and Vertical Granulator (manufactured by Powrex Corp.). A particular preference is given to a mixer containing an agitating shaft arranged along the center line of a horizontal, cylindrical blending vessel and agitating impellers arranged on the agitating shaft, to carry out blending of the components, including Lödige Mixer (manufactured by Matsuzaka Giken Co., Ltd.), and PLOUGH SHARE Mixer (manufactured by PACIFIC MACHINERY & ENGINEERING Co., LTD.).

(2) A mixer comprising a rotatable V-shaped blending vessel, to carry out blending of the components, including, for instance, V-type Mixer (manufactured by Fuji Paudal Co., Ltd.).

(3) A mixer comprising spiral ribbon impeller in a semi-cylindrical, non-rotatable vessel, to carry out blending of the components, including, for instance, Ribbon Mixer (manufactured by Fuji Paudal Co., Ltd.).

(4) A mixer containing a screw having a rotating shaft arranged parallel to the vessel wall, while revolving the screw along a conical vessel, to carry out blending of the components, including, for instance, Nauta Mixer (manufactured by Hosokawa Micron Corp.), and SV Mixer (Shinko Panreck Co., Ltd.).

Examples of devices preferably used for a continuous process include devices (1) to (3) given below.

(1) A continuous mixer comprising a vertical cylinder having a powder supply opening and a main shaft having a blending blade, the main shaft being supported by an upper bearing and the vertical cylinder having a free discharging side, to carry out blending of the components, including, for instance, Flexo Mix (manufactured by Powrex Corp.).

(2) A continuous mixer comprising a disc plate with agitating pins, to which the starting materials are supplied on the upper portion of the disc plate, the disc plate being rotated at a high speed, to thereby carry out blending of the components with a shear force, including, for instance Flow Jet Mixer (manufactured by Funken Powtechs, Inc.), and Spiral Pin Mixer (manufactured by PACIFIC MACHINERY & ENGINEERING Co., LTD.).

(3) A continuous mixer containing an agitating shaft arranged in the inner portion of the blending vessel and agitating impellers arranged on the shaft, to carry out blending of the components. Specifically, Continuous Henschel Mixer (manufactured by Mitsui Miike Machinery Co., Ltd.) may be used. Further, devices, such as High-Speed Mixer (Fukae Powtec Corp.), and Vertical Granulator (manufactured by Powrex Corp.) may be used as continuous mixing devices. A preference is given to a continuous-type mixer containing an agitating shaft along the center line of a horizontal, cylindrical blending vessel and agitating impellers arranged on the agitating shaft, to carry out blending of the components, including Lödige Mixer (manufactured by Matsuzaka Giken Co., Ltd.), and PLOUGH SHARE Mixer (manufactured by PACIFIC MACHINERY & ENGINEERING Co., LTD.).

Step (II)

Step (II) is a process for preparing a granulated product using a mixture obtained in step (I). In step (II), the temperature of the mixture obtained in step (I) may be adjusted to a temperature at least sufficiently high enough to neutralize the acid precursor of the anionic surfactant capable of having a lamellar orientation, namely, at a temperature high enough to have both the nonionic surfactant and the above acid precursor in liquid states. The temperature is set as mentioned above so that at least one of an alkali builder and an alkali, porous oil-absorbing carrier is allowed to react with the above acid precursor at a high efficiency, to give a gelated product.

More specifically, in the case where at least one of a nonionic surfactant and an aqueous nonionic surfactant solution is blended in advance with the above acid precursor in step (I), to give a mixed solution, the temperature of the mixture is adjusted to A) a temperature not lower than the melting point of the mixed solution. Alternatively, in the case where at least one of a nonionic surfactant and an aqueous nonionic surfactant solution, and the above acid precursor in step (I) are added without mixing in advance, the temperature of the mixture is adjusted to B) a temperature not lower than the melting point of the component with a higher melting point.

Here, the temperature to be adjusted is not particularly restricted as long as it is higher than the melting point given in A) or B) given above for accelerating the reaction. However, for practically purposes, a preferred range is a temperature which is higher than a given melting point by 0° to 50° C., more preferably a temperature which is higher than a given melting point by 10° to 30° C.

Incidentally, in order to accelerate the progress of the reaction, water may be properly added in step (I) or (II). Alternatively, an aqueous alkali solution, such as an aqueous sodium silicate solution, an aqueous sodium hydroxide solution, or an aqueous potassium hydroxide solutions, may be added in an amount not more than that equivalent for the neutralization of the acid precursor in step (I) or (II).

When the reaction takes place, a gelated product carrying a nonionic surfactant is formed on a surface of alkali powders, such as builders and oil-absorbing carriers, and the formed gelated product serves not only to act as a binder in the granulation process in step (II) but also to improve the supporting force of the powder surface to the nonionic surfactant, to thereby presumably inhibiting exudation. Incidentally, although the temperature of the granulation product at completion of step (II) is not particularly limited, it is preferably at a temperature higher than the melting point given in A) or B) above by not less than 10° C., more preferably by not less than 20° C. In general, higher the reaction temperature, more the reaction is accelerated, but it is desired to select a temperature suitable for industrial purposes. When the temperature is higher than the melting point given above by 10° C., the gelated products more efficiently form, making it highly advantageous.

In the granulation process of step (II) mentioned above, in certain cases, the temperature in the agitating mixer is set at a given temperature. In such a case, the agitating mixer having easily temperature-controllable functions are preferable. A preference is given to, for instance, an agitating mixer equipped with a jacket capable of flowing heated water and thus setting the temperature inside the jacket to higher than the melting point of the nonionic surfactant and the acid precursor of the anionic surfactant capable of having lamellar orientation, because the temperature of the agitating mixer can be easily controlled. Incidentally, in order to produce the granulated product at a desired temperature at completion of step (II) mentioned above, the jacket temperature is suitably controlled.

In addition, among the mixers, a preference is given an agitating mixer containing an agitation shaft along a center line of the agitating mixer, and agitation impellers arranged on the agitating shaft, from the viewpoint of highly efficiently forming the gelated products mentioned above used as binders while tumbling and granulating the agitating mixer. Examples of the agitating mixers having such constructions include devices, such as Henschel Mixer (manufactured by Mitsui Miike Machinery Co., Ltd.), High-Speed Mixer (Fukae Powtec Corp.), and Vertical Granulator (manufactured by Powrex Corp.). A particular preference is given to a mixer containing an agitating shaft along the center line of a horizontal, cylindrical blending vessel and agitating impellers arranged on the agitating shaft, to carry out blending of the components, including Lödige Mixer (manufactured by Matsuzaka Giken Co., Ltd.), and PLOUGH SHARE Mixer (manufactured by PACIFIC MACHINERY & ENGINEERING Co., LTD.). In the case of the agitating mixer equipped with agitating impellers, a Froude number defined below, is preferably 1 to 4, more preferably 1.2 to 3.0, based on the rotation of the agitating impeller of the agitating mixer. When the Froude number exceeds 4, the agitating force becomes too strong, thereby making it likely to produce granulated products with a broad granular distribution. When the Froude number is less than 1, the blending efficiency becomes poor, thereby making it likely to produce granulated products with a broad granular distribution.

Here, the Froude number is defined as follows.

$$Fr=V^2/(R\times g),$$

wherein Fr stands for a Froude number, V stands for a peripheral speed of a tip end portion of an agitating impeller (m/s), R stands for a rotational radius (m) of an agitating impeller (m), and g stands for gravitational acceleration ($m/s^2$).

In step (II), although the granulation time for a granulation process by a batch process or the average residence time for granulating by a continuous process for obtaining a desired granulated product is not particularly limited, the granulation time or the average residence time is preferably from 2 to 20 minutes, more preferably 3 to 10 minutes. From the viewpoint of accelerating the neutralization reaction, the granulation time or the average residence time is preferably not less than 2 minutes, and from the viewpoint of productivity, the granulation time or the average residence time is preferably not more than 20 minutes.

Surface-Coating Step

In the present invention, for the purpose of coating the surface of the granulated product obtained after the granulation process in step (II), the method of the present invention may further comprise a surface-coating step for adding a fine powder as a surface coating. By coating the surface of the granulated product, the fluidity and the non-caking property of the granulated product are likely to be improved, making it highly advantageous. The surface coating is added after the granulation process because when added at start or an intermediary stage of the granulation process, the surface coating is incorporated in the inner portion of the granulated product, thereby making unsatisfactory in the improvements for the fluidity and the non-caking property of the granulated product. Here, "after the granulation process" refers to a point where a granulated product with a desired average particle size in the range of from 250 to 1,000 μm is produced upon granulation. Also, the fine powder preferably has an average primary particle size of not more than 10 μm. This means that the any fine powder may be used as long as it has an average particle size of not more than 10 μm at the time which the fine powder coats the surface of the granulated product, including a case where an agglomerate of fine powder having an average particle size of from 20 to 30 μm is disintegrated, and then the granulated product is coated therewith during the surface-coating step. When the average particle size exceeds 10 μm, the coating percentage of the surface of the granulated product is lowered, thereby making it impossible to obtain desired nonionic detergent granules. The average particle size of the fine powder mentioned above may be measured by a method utilizing a light scattering, for example, "PARTICLE ANALYSER" (manufactured by Horiba, Ltd.), or a microscopic observation.

Preferred examples of the surface coatings include aluminosilicates because of their actions as a calcium ion capturing agent upon washing, with a particular preference given to aluminosilicates having an average primary particle size of not more than 10 μm. The aluminosilicates may be crystalline or amorphous. Besides the aluminosilicates, inorganic fine powders such as calcium silicates, silicon dioxide, bentonite, talc, clay, amorphous silica derivatives, silicate compounds such as crystalline silicate compounds, each having an average primary particle size of not more than 10 μm, are also preferred. Examples of the aluminosilicates are listed for materials for inorganic builders and porous, oil-absorbing carrier. Also, metal soaps having an average primary particle size of not more than 10 μm can be similarly used.

Among the above materials, a preference is given to one or more selected from the group consisting of crystalline or amorphous aluminosilicates, calcium silicates, and crystalline silicate compounds having ion exchange capacity of not less than 100 $CaCO_3$ mg/g, with a particular preference given to crystalline or amorphous aluminosilicates and calcium silicates.

The amount of the fine powder used is preferably from 0.5 to 20 parts by weight, more preferably from 1 to 15 parts by weight, particularly from 2 to 10 parts by weight, based on 100 parts by weight of the granulated product. When the amount of the fine powder exceeds 20 parts by weight, the fluidity becomes poor, and powdery dust is likely to be generated, thereby undesirably causing discomfort for the consumers. On the other hand, when the amount is less than 0.5 parts by weight, the production of the powder having good fluidity is likely to become difficult.

The devices used in the surface-coating step are not particularly limited, and any of known mixers can be used, with a preference given to the mixers exemplified in steps (I) and (II) mentioned above. In particular, mixers given in step (II) are suitably used.

The nonionic detergent granules in the present invention are produced by the steps (I) and (II), preferably by steps (I) and (II) and a surface-coating step. For instance, step (II) and the surface-coating step can be carried out by a batch process using the devices given in the description of step (II).

Alternatively, in the case where step (II) and the surface-coating step can be carried out by a continuous process, devices having such a construction that supplying of the starting materials and discharging of the granulated product are continuously carried out may be used.

In the case where the present invention is carried out by a batch process, steps (I) and (II) or steps (I), (II), and the surface-coating step can be carried out in the same device by using an agitating mixer used in step (II). Partial granulation takes place in step (I), and after completion of step (I), the mixture is further mixed and agitated, to thereby further progress the granulation. In the case where steps (I), (II), and the surface-coating step are carried out in the same device, a particular preference is given to those having an agitating mixing vessel containing a horizontal agitating shaft along the center line of the horizontal, cylindrical mixing vessel.

In the case where the present invention is carried out by a continuous process, steps (I) and (II) can be carried out in the same device by using an agitating mixer used in step (II). Steps (I) and (II), or step (II) and the surface-coating step, or steps (I), (II), and the surface-coating step may be continuously carried out in the same device when using a mixing vessel having a partitioned structure (for instance, by providing partition plates) having partitions arranged perpendicular to the wall along the direction of the agitating shaft, the mixing vessel comprising an agitating mixing vessel containing a horizontal agitating shaft along the center line of the horizontal, cylindrical mixing vessel.

In addition, the amount of each of the detergent starting materials mentioned above supplied in the mixer is preferably not more than 70 volume %, more preferably from 15 to 40 volume % of the entire volume in at any stage whether implementing a batch process or a continuous process. When the amount exceeds 70 volume %, the blending efficiency of the detergent starting materials in the mixer is likely to be undesirably lowered.

Further, in steps (I) and (II) of the present invention, or after the surface-coating step, the following additives may be added.

(1) Bleaching agents

Examples thereof include sodium percarbonate, sodium perborate, sodium sulfate-hydrogen peroxide addition compounds, and the like.

(2) Enzymes

The enzymes are not particularly limited, and any of known enzymes generally used for detergents may be used. A preference is given to protease, cellulase, amylase, and lipase.

(3) Surfactant powder

Examples thereof include powdery anionic surfactants, such as alkylbenzenesulfonates, alkyl or alkenyl ether sulfates, alkyl or alkenyl sulfates, α-olefinsulfonates, α-sulfonated fatty acid salts, α-sulfonated fatty acid esters, alkyl or alkenyl ether carboxylates, and soaps; powdery ampholytic surfactants such as carbobetaine-type and sulfonated betaine-type ampholytic surfactants; powdery cationic surfactants such as di-long chain quaternary ammonium salts.

(4) Others

Examples of other additives include blueing agents, caking preventives, antioxidants, fluorescent dyes, photoactivated bleaching agents, perfumes, and recontamination preventives, each of which is not being particularly limited, and any additives generally used for detergent may be used.

By using the granulation method in the present invention, the resulting detergent granules are advantageous in being less susceptible in having a compositional restriction, because the ratio of the powder starting materials and the nonionic surfactant constituting detergent starting materials can be arbitrarily chosen without having the following compositional restrictions: (1) a compositional restriction in the granulation process in utilizing hydration of washing active salts, and (2) a compositional restriction in ensuring operational safety in solidification and disintegration method.

In addition, detergent granular compositions containing an anionic surfactant as a main surfactant component produced by methods disclosed in Japanese Patent Laid-Open Nos. 60-72999, 60-96698, 61-69897, 61-76597, 61-272300, 1-311200, 2-29500, 3-33199, 3-115400, 3-146599, 4-81500, and 5-86400, and Japanese Patent Unexamined Publication Nos. 6-502212 and 6-506720 may be blended in the composition in a suitable proportion.

The nonionic detergent granules obtained in the present invention preferably have the following properties.

(1) Having a bulk density of from 0.6 to 1.2 g/ml, preferably 0.7 to 1.0 g/ml.

(2) Having an average particle size, obtained by a method explained below, of from 250 to 800 μm, preferably from 300 to 600 μm.

(3) Having a fluidity in terms of flow time, which is a time period required for dropping 100 ml of powder from a hopper used in a measurement of bulk density according to JIS K 3362, of not more than 10 seconds, preferably not more than 8 seconds.

(4) Having a caking property evaluated by sieve permeability, obtained by a method explained below, of not less than 90%, preferably not less than 95%.

(5) Having an exudation property determined by gross examination measured by the method described in Examples given hereinbelow of two ranks or better, preferably 1 rank.

Here, the bulk density is preferably not more than 1.2 g/ml from the viewpoint of the solubility of the obtained detergent granules. The average particle size is preferably not more than 800 μm from the viewpoint of the solubility of the detergent granules, and preferably not less than 250 μm from the viewpoint from inhibiting the generation of powder dusts. The fluidity in terms of the flow time is preferably not more than 10 seconds from the viewpoint of easiness in handless of the resulting detergent granules. The caking property evaluated by sieve permeability is preferably not less than 90% from the viewpoint of inhibiting the caking phenomenon upon storage. The exudation property determined by gross examination is preferably two ranks or better from the viewpoint of preventing the adhesion of the nonionic surfactant-containing granules to conveying equipments.

By using the method for producing nonionic detergent granules of the present invention, the nonionic detergent granules have small compositional restrictions without being restricted in certain materials used, a high bulk density, a further higher nonionic surfactant content, excellent powder fluidity and non-caking property, and are free from exudation.

EXAMPLES

The present invention will be explained in further detail by means of the following Examples and Comparative Examples, without limiting the scope of the present invention thereto.

In the following Examples and Comparative Examples, the following components are used:

"DENSE ASH, ZEOLITE 4A"

manufactured by Tosoh Corporation;

"PULVERIZED LIGHT ASH"

obtained by pulverizing "LIGHT ASH" (manufactured by Tosoh Corporation) using Atomizer (manufactured by Fuji Paudal Co., Ltd.);

Amorphous Aluminosilicates manufactured by Kao Corporation.

Also, the pHs of each of the builders, porous, oil-absorbing carrier, when prepared as an aqueous solution or a dispersed solution, at 20° C. with a concentration of 1 g/liter, used in the following Examples and Comparative Examples are as follows.

| | |
|---|---|
| DENSE ASH | 11.1 |
| LIGHT ASH | 11.1 |
| PULVERIZED LIGHT ASH | 11.0 |
| ZEOLITE 4A | 9.8 |
| Amorphous aluminosilicate | 10.4 |
| Sodium sulfate | 7.1 |

Example 1

25 parts by weight of a nonionic surfactant and 10 parts by weight of a fatty acid listed in Table 1 were blended while heating the mixture to a temperature of 70° C., to prepare a mixed solution. Next, 35 parts by weight of DENSE ASH, 10 parts by weight of ZEOLITE 4A, and 20 parts by weight of an amorphous aluminosilicate were supplied in Lödige Mixer (manufactured by Matsuzaka Giken Co., Ltd.; capacity: 20 liters; equipped with a jacket), and agitation was initiated with the mixer having a main axis (150 rpm) and a chopper (4,000 rpm). Incidentally, heated water of 75° C. was supplied in the jacket at a flow rate of 10 liters/minute. To the above mixture, the mixed solution was added while agitating in a period of 4 minutes, and after the added mixture was agitated for 6 minutes, the resulting nonionic detergent granules were discharged. The entire amount supplied was 4 kg. The bulk density, the average particle size, the fluidity, the caking property, and the exudation property of the nonionic detergent granules thus obtained were measured. The results are shown in Table 3.

Here, the bulk density was measured by a method according to JIS K 3362. The average particle size was measured by vibrating standard sieves according to JIS Z 8801 vibrated for 5 minutes to calculate a weight percentage depending upon the size opening of the sieves. The fluidity of the powder was evaluated by the time required for dropping 100 ml of powder from a hopper used in a measurement of bulk density according to JIS K 3362.

The testing method for caking property was as follows.

Caking Test Method

A lidless box having dimensions of 10.2 cm in length, 6.2 cm in width, and 4 cm in height was made out of a filter paper (TOYO FILTER PAPER NO. 2) by stapling the filter paper at four corners. A 50 g sample was placed in this box, and an acrylic resin plate with a weight of 15 g and a lead plate (or an iron plate) with a weight of 250 g were placed on the sample. The above box was maintained in a thermostat kept at a constant humidity under conditions of a temperature of 30° C. and a humidity of 80%, the caking conditions after 7 days were evaluated by calculating the permeability as explained below.

[Permeability]

A sample obtained after the treatment in a thermostat mentioned above was carefully placed on a wire net (or a sieve, with 5 mm×5 mm meshes), and the weight of the powder passing through the wire net was measured. The permeability, based on the sample obtained after treatment in a thermostat was calculated by the following equation:

$$\text{Permeability (\%)} = \frac{\text{Weight of Powder Passing Through Wire Net (g)}}{\text{Weight of Sample Obtained after Treatment (g)}} \times 100$$

In addition, the testing method for exudation property was as follows.

Exudation Test Method

The exudation conditions were evaluated by a gross examination of a mixed solution of a nonionic surfactant and a fatty acid on the bottom portion of the box obtained after the caking test, the examination being made from a side where the powder is not contacted therewith. The evaluation for exudation property was made based on the area of wetted portion occupying the bottom portion of the box in 1 to 5 ranks. Each of the ranks were determined as follows:

| | |
|---|---|
| Rank 1: | Not wetted. |
| 2: | About ¼ the area being wetted. |
| 3: | About ½ the area being wetted. |
| 4: | About ¾ the area being wetted. |
| 5: | The entire area being wetted. |

Example 2

The starting materials listed in Table 1 were subject to a granulation treatment in the same manner as in Example 1, to give nonionic detergent granules. Thereafter, 8 parts by weight of ZEOLITE 4A used as a surface coating were supplied in Lödige Mixer containing the nonionic detergent granules, and the obtained mixture was agitated for 1.5 minutes, followed by discharging the resulting coated nonionic detergent granules. The nonionic detergent granules obtained above were evaluated in the same manner as in Example 1. The results are shown in Table 3.

Example 3

Forty parts by weight of DENSE ASH, 10 parts by weight of ZEOLITE 4A, and 20 parts by weight of an amorphous aluminosilicate, each of the components being listed in Table 1, were supplied in Lödige Mixer (manufactured by Matsuzaka Giken Co., Ltd.; capacity: 20 liters; equipped with a jacket), and agitation was initiated. To the above mixture, 25 parts by weight of a nonionic surfactant and 5 parts by weight of a fatty acid listed in Table 1, each heated to 75° C., were simultaneously supplied in the mixer while agitating in a period of 3 minutes without blending the nonionic surfactant and the fatty acid in advance. Thereafter, the added mixture was agitated for 6 minutes. Incidentally, the agitation was carried out with the mixer having a main axis (150 rpm) and a chopper (4,000 rpm) while supplying heated water of 75° C. in the jacket at a flow rate of 10 liters/minute. Further, 8 parts by weight of ZEOLITE 4A used as a surface coating were supplied in Lödige Mixer containing the nonionic detergent granules, and the obtained mixture was agitated for 1.5 minutes, followed by discharging the resulting coated nonionic detergent granules. The coated nonionic detergent granules obtained above were evaluated in the same manner as in Example 1. The results are shown in Table 3.

Example 4

25 parts by weight of a nonionic surfactant and 10 parts by weight of alkylsulfuric acid listed in Table 1 were blended while heating the mixture to a temperature of 30° C., to prepare a mixed solution. Next, 40 parts by weight of DENSE ASH, 5 parts by weight of ZEOLITE 4A, and 20 parts by weight of an amorphous aluminosilicate were supplied in Lödige Mixer (manufactured by Matsuzaka Giken Co., Ltd.; capacity: 20 liters; equipped with a jacket), and agitation was initiated in the same manner as in Example 1. Incidentally, heated water of 40° C was supplied in the jacket at a flow rate of 10 liters/minute. To the above mixture, the mixed solution was added while agitating in a period of 4 minutes. After the added mixture was agitated for 6 minutes, 8 parts by weight of ZEOLITE 4A were supplied as a surface coating, and then the obtained mixture was agitated for 1.5 minutes. Thereafter, the resulting nonionic detergent granules were discharged. The nonionic detergent granules obtained above were evaluated in the same manner as in Example 1. The results are shown in Table 3.

Examples 5 to 9

The starting materials for each of the Example listed in Tables 1 and 2 were subject to a granulation treatment and a surface-coating treatment in the same manner as in Example 2, to give nonionic detergent granules. The nonionic detergent granules obtained in each Example were evaluated in the same manner as in Example 1. The compositions and the evaluation results therefor are shown in Tables 1 to 3.

Comparative Example 1

The starting materials listed in Table 2 were subject to a granulation treatment and a surface-coating treatment in the same manner as in Example 2, to give nonionic detergent granules. The obtained nonionic detergent granules were evaluated in the same manner as in Example 1. The compositions and the evaluation results therefor are shown in Tables 2 and 3. Incidentally, cold water of 10° C. was supplied in the jacket at a flow rate of 10 liters/minute. Also, the agitation time after adding the nonionic surfactant was 6 minutes. In addition, the agitation time upon surface coating was 1.5 minutes.

Comparative Example 2

The powdery starting materials listed in Table 2 was supplied in Nauta Mixer (manufactured by Hosokawa Micron Corp.; capacity: 30 liters; equipped with a jacket), and agitation (20 rpm) was initiated. Incidentally, heated water of 75° C. was supplied in the jacket at a flow rate of 10 liters/minute. To the above mixture, a nonionic surfactant was added while agitating in a period of 4 minutes. Thereafter, the added mixture was agitated for 20 minutes. Further, 8 parts by weight of ZEOLITE 4A used as a surface coating were supplied in the above mixer, and the obtained mixture was agitated for 1.5 minutes, followed by discharging the resulting coated nonionic detergent granules. The entire amount supplied was 5 kg. The nonionic detergent granules obtained above were evaluated in the same manner as in Example 1. The results are shown in Table 3.

Comparative Example 3

The starting materials listed in Table 2 were subject to a granulation treatment and a surface-coating treatment in the same manner as in Example 2, to give nonionic detergent granules. The obtained nonionic detergent granules were evaluated in the same manner as in Example 1. The compositions and the evaluation results therefor are shown in Tables 2 and 3.

Comparative Example 4

The starting materials listed in Table 2 were subject to a granulation treatment and a surface-coating treatment in the same manner as in Example 1, to give nonionic detergent granules. The obtained nonionic detergent granules were evaluated in the same manner as in Example 1. The compositions and the evaluation results therefor are shown in Tables 2 and 3.

TABLE 1

| Composition (parts by weight) | | Examples 1 | 2 | 3 | 4 | 5 | 6 | 7 |
|---|---|---|---|---|---|---|---|---|
| Nonionic Surfactant | Polyoxyethylene dodecyl ether*1 | 25 | 25 | 25 | 25 | 25 | | |
| Aqueous nonionic surfactant solution | Polyoxyethylene dodecyl ether, Water 5% | | | | | | 30 | 15 |
| Fatty acid | Palmitic acid (average particle size: 20 μm) | 10 | 5 | 5 | | 5 | 5 | 5 |
| Soap | Sodium palmitate | | | | | | | |
| Alkylsulfuric acid | Laurylsulfuric acid | | | | 10 | | | |
| Linear alkylbenzene-sulfonic acid | Dodecylbenzene-sulfonic acid | | | | | | | |
| Alkali Builder | DENSE ASH (average particle size: 290 μm) | 35 | 40 | 40 | 40 | 30 | 30 | 35 |
| | PULVERIZED LIGHT ASH (average particle size: 8 μm) | | | | | | | 35 |
| | ZEOLITE-4A (average particle size: 3 μm) | 10 | 10 | 10 | 5 | 10 | 10 | 10 |
| | Crystalline silicate (average particle size: 30 μm) | | | | | | | |
| Alkali, porous oil-absorbing carrier | Amorphous aluminosilicate (average particle size: 10 μm)*2 | 20 | 20 | 20 | 20 | 20 | 25 | |
| Neutral or acidic builder | Sodium sulfate (average particle size: 280 μm) | | | | | 10 | | |

*1: Average molar number of ethylene oxide adduct = 8; melting point: 15° C.; HLB 10.14

*2: Composition: $Na_2O.Al_2O_3.3SiO_2$ Microporous capacity = 245 $cm^3$/100 g; specific surface area = 64 $m^2$/g; oil-absorbing capacity = 180 ml/100 g; water content after drying at 800° C., 1 Hr = 26.5%; primary particle size = 0.05 μm

TABLE 2

| Composition (parts by weight) | | Examples 8 | 9 | Comparative Examples 1 | 2 | 3 | 4 |
|---|---|---|---|---|---|---|---|
| Nonionic Surfactant | Polyoxyethylene dodecyl ether*1 | 25 | 25 | 25 | 30 | 25 | 25 |
| Aqueous nonionic surfactant solution | Polyoxyethylene dodecyl ether, Water 5% | | | | | | |
| Fatty acid | Palmitic acid (average particle size: 20 μm) | 5 | 5 | 5 | | | |
| Soap | Sodium palmitate | | | | | | 5 |
| Alkylsulfuric acid | Laurylsulfuric acid | | | | | | |
| Linear alkylbenzene-sulfonic acid | Dodecylbenzene-sulfonic acid | | | | | 5 | |
| Alkali Builder | DENSE ASH (average particle | 40 | 40 | 40 | 40 | 40 | 40 |

TABLE 2-continued

| Composition (parts by weight) | | Examples 8 | Examples 9 | Comparative Examples 1 | 2 | 3 | 4 |
|---|---|---|---|---|---|---|---|
| | size: 290 μm) PULVERIZED LIGHT ASH (average particle size: 8 μm) | | | | | | |
| | ZEOLITE-4A (average particle size: 3 μm) | 10 | 10 | 10 | 10 | 10 | 10 |
| | Crystalline silicate (average particle size: 30 μm) | | 10 | | | | |
| Alkali, porous oil-absorbing carrier | Amorphous aluminosilicate*2 (average particle size: 10 μm) | 20 | 20 | 20 | 20 | 20 | 20 |
| Neutral or acidic builder | Sodium sulfate (average particle size: 280 μm) | | | | | | |

*1: Average molar number of ethylene oxide adduct = 8; melting point: 15° C.; HLB 10.14

*2: Composition: $Na_2O.Al_2O_3.3SiO_2$

Microporous capacity = 245 $cm^3$/100 g; specific surface area = 64 $m^2$/g; oil-absorbing capacity = 180 ml/100 g; water content after drying at 800° C., 1 Hr = 26.5%; primary particle size = 0.05 μm

TABLE 3

| Surface Coating (parts by weight) | Example Nos. 1 | 2 | 3 | 4 | 5 | 6 | 7 | 8 | 9 | Comparative Examples 1 | 2 | 3 | 4 |
|---|---|---|---|---|---|---|---|---|---|---|---|---|---|
| ZEOLITE-4A (Average particle size 3 μm) | | 8 | 8 | 8 | 8 | 8 | 8 | | 8 | 8 | 8 | 8 | 8 |
| Amorhpous aluminosilicate*2 (Average particle size 10 μm) | | | | | | | | 3 | | | | | |
| Jacket Temp. (°C.) | 75 | 75 | 75 | 40 | 75 | 75 | 75 | 75 | 75 | 10 | 75 | 75 | 75 |
| Bulk density (g/ml) | 0.81 | 0.83 | 0.83 | 0.83 | 0.83 | 0.81 | 0.84 | 0.84 | 0.86 | 0.75 | 0.66 | 0.75 | 0.73 |
| Average particle size (μm) | 440 | 420 | 425 | 410 | 415 | 395 | 380 | 415 | 420 | 525 | 240 | 450 | 515 |
| Fluidity (sec) | 7.2 | 6.9 | 6.9 | 7.2 | 7.0 | 6.8 | 7.2 | 6.7 | 6.8 | 10.4 | No cascading | 10.2 | 10.0 |
| Caking property (Permeability) (%) | 100 | 100 | 100 | 100 | 100 | 100 | 100 | 100 | 100 | 100 | 73 | 70 | 70 |
| Exudation property | 1–2 | 1–2 | 1–2 | 1–2 | 1–2 | 1–2 | 1–2 | 1 | 1–2 | 4–5 | 4–5 | 4–5 | 4–5 |

*2: Composition: $Na_2O.Al_2O_3.3SiO_2$

Microporous capacity = 245 $cm^3$/100 g; specific surface area = 64 $m^2$/g; oil-absorbing capacity = 180 ml/100 g; water content after drying at 800° C., 1 Hr = 26.5%; primary particle size = 0.05 μm

Example 10

A slurry having a water content of 50% by weight was spray-dried to give spray-dried particles having the following composition.

| | |
|---|---|
| ZEOLITE 4A | 12.9 parts by weight |
| Sodium sulfate | 5.0 parts by weight |
| Sodium stearate | 1.0 part by weight |
| Sodium salt of carboxymethylcellulose | 0.1 parts by weight |
| Water | 1.0 part by weight |

The starting materials listed in Tables 4 and 5 were subject to a granulation treatment and a surface-coating treatment in the same manner as in Example 2 by using the spray-dried particles obtained above, to give nonionic detergent granules. The obtained nonionic detergent granules were evaluated in the same manner as in Example 1. The compositions and the evaluation results therefor are shown in Tables 4, 5, and 6.

Example 11

A slurry having a water content of 50% by weight was spray-dried to give spray-dried particles having the following composition.

| | |
|---|---|
| ZEOLITE 4A | 13.9 parts by weight |
| Sodium sulfate | 5.0 parts by weight |
| Sodium salt of carboxymethylcellulose | 0.1 parts by weight |
| Water | 1.0 part by weight |

The starting materials listed in Tables 4 and 5 were subject to a granulation treatment and a surface-coating treatment in the same manner as in Example 2 by using the spray-dried particles obtained above, to give nonionic detergent granules. The obtained nonionic detergent granules were evaluated in the same manner as in Example 1.

The compositions and the evaluation results therefor are shown in Tables 4, 5, and 6.

Example 12

25 parts by weight of a nonionic surfactant and 5 parts by weight of a fatty acid listed in Table 4 were blended while heating the mixture to a temperature of 70° C., to prepare a mixed solution. Next, 30 parts by weight of the mixed solution, 40 parts by weight of DENSE ASH, 10 parts by weight of ZEOLITE 4A, and 20 parts by weight of an amorphous aluminosilicate were continuously supplied and blended in FLEXOMIX 160 (manufactured by Powrex Corp.). At this time, the entire amount supplied was 250 kg/hr, and a rotational speed of the main shaft was 3000 rpm. Also, the mixed solution was sprayed to the above mixture in the mixer using a one-fluid nozzle at a pressure of 2 kg/$cm^2$. Next, the blended detergent starting materials were continuously supplied in Lödige Mixer KM-150D (manufactured by Matsuzaka Giken Co., Ltd.; equipped with a jacket) to carry out granulation. At this time, the rotational speed of the main shaft was 105 rpm, the rotational speed of the chopper was 3440 rpm, and heated water of 75° C. was supplied in the jacket at a flow rate of 10 liters/minute. Incidentally, the average residence time was 6.1 minutes.

Further, 100 parts by weight of the granulated detergent starting materials obtained above and 8 parts by weight of ZEOLITE 4A were continuously supplied and blended in a continuous mixer having the same construction as Lödige Mixer mentioned above (capacity 40 liters; manufactured by Kao Corporation), to give nonionic detergent granules. At this time, the rotational speed of the main shaft was 130 rpm, the rotational speed of the chopper was 4000 rpm, and heated water of 75° C. was supplied in the jacket at a flow rate of 10 liters/minute. Incidentally, the average residence time was 1.5 minutes. The obtained nonionic detergent granules were evaluated in the same manner as in Example 1. The compositions and the evaluation results therefor are shown in Tables 4, 5, and 6.

Example 13

Detergent starting materials having the same composition as in Example 12 were continuously supplied in Lödige Mixer KM-150D (manufactured by Matsuzaka Giken Co., Ltd.; equipped with a jacket) to simultaneously carry out blending and granulation. At this time, the entire amount supplied was 250 kg/hr, and a rotational speed of the main shaft was 105 rpm and a rotational speed of the chopper was 3440 rpm, and heated water of 75° C. was supplied in the jacket at a flow rate of 10 liters/minute. Incidentally, the average residence time was 6.0 minutes. Also, the mixed solution was sprayed to the above mixture in the mixer using a one-fluid nozzle at a pressure of 2 kg/cm$^2$. Incidentally, the step for coating the granulated product was carried out in the same manner as in Example 12, to give nonionic detergent granules. The obtained nonionic detergent granules were evaluated in the same manner as in Example 1. The compositions and the evaluation results therefor are shown in Tables 4, 5, and 6.

TABLE 4

| Composition (parts by weight) | | Examples 10 | 11 | 12 | 13 |
|---|---|---|---|---|---|
| Nonionic Surfactant | Polyoxyethylene dodecyl ether*1 | 25 | 25 | 25 | 25 |
| Fatty acid | Palmitic acid | 5 | 5 | 5 | 5 |
| Alkali Builder | DENSE ASH (average particle size: 290 μm) | 20 | 20 | 40 | 40 |
| | ZEOLITE-4A (average particle size: 3 μm) | 10 | 10 | 10 | 10 |
| Alkali, porous oil-absorbing carrier | Amorphous aluminosilicate*2 (average particle size: 10 μm) | 20 | 20 | 20 | 20 |

*1: Average molar number of ethylene oxide adduct = 8; melting point: 15° C.; HLB 10.14

*2: Composition: $Na_2O.Al_2O_3.3SiO_2$
Microporous capacity = 245 cm$^3$/100 g; specific surface area = 64 m$^2$/g; oil-absorbing capacity = 180 ml/100 g; water content after drying at 800° C., 1 Hr = 26.5%; primary particle size = 0.05 μm

TABLE 5

| Composition (parts by weight) | | Examples 10 | 11 | 12 | 13 |
|---|---|---|---|---|---|
| Spray-dried Particles*3 | ZEOLITE-4A | 12.9 | 13.9 | | |
| | Sodium sulfate | 5.0 | 5.0 | | |
| | Sodium stearate | 1.0 | | | |
| | Sodium salt of carboxymethylcellulose | 0.1 | 0.1 | | |
| | Water | 1.0 | 1.0 | | |
| Surface Coating | ZEOLITE-4A (average particle size: 3 μm) | 8 | 8 | 8 | 8 |
| Jacket Temperature (°C.) | | 75 | 75 | 75 | 75 |

*3Example 10: Bulk density: 0.45 g/ml; average particle size: 245 μm
Example 11: Bulk density: 0.69 g/ml; average particle size: 215 μm

TABLE 6

| | Examples 10 | 11 | 12 | 13 |
|---|---|---|---|---|
| Bulk density (g/ml) | 0.75 | 0.82 | 0.83 | 0.82 |
| Average particle size (μm) | 395 | 380 | 425 | 415 |
| Fluidity (sec) | 6.8 | 6.7 | 6.7 | 6.8 |
| Caking property (permeability) (%) | 100 | 100 | 100 | 100 |
| Exudation property | 1–2 | 1–2 | 1–2 | 1–2 |

As is clear from the above results, each of the nonionic detergent granules of Examples 1 to 13 produced according to the method of the present invention has a high bulk density, good fluidity and non-caking property, and free from exudation property. On the other hand, by carrying out the granulation temperature at a low temperature of 10° C., the detergent granules having poor fluidity and exudation were obtained (Comparative Example 1). Also, each of the following detergent granules had poor fluidity, caking property, and exudation property: the detergent granules containing no acid precursors (fatty acids) of an anionic surfactant capable of having a lamellar orientation (Comparative Example 2); the detergent granules formulated with an acid precursor (linear alkylbenzenesulfonic acid) of an anionic surfactant not having a lamellar orientation (Comparative Example 3); and detergent granules blended with a soap in place of an acid precursor (Comparative Example 4).

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for producing nonionic detergent granules comprising the steps of:

(I) blending the following (i) to (iii):

(i) at least one of a nonionic surfactant and an aqueous nonionic surfactant solution;

(ii) an acid precursor of an anionic surfactant capable of having a lamellar orientation selected from the group consisting of saturated or unsaturated fatty acids having 10 to 22 carbon atoms, alkylsulfuric acids having 10 to 22 carbon atoms, α-sulfonated fatty acids having 10 to 22 carbon atoms, and polyoxyethylene alkyl ether sulfuric acids whose alkyl moieties have 10 to 22 carbon atoms and whose ethylene oxide moieties have an average molar number of from 0.2 to 2.0;

(iii) at least one of an alkali builder and an alkali, porous oil-absorbing carrier, said acid precursor of an anionic surfactant is present in an amount of 5 to 60 parts by weight based on 100 parts by weight of at least one of the nonionic surfactant and the aqueous nonionic surfactant solution to give a mixture of detergent starting materials containing the nonionic surfactant as a main surfactant component; and (II) heating the mixture obtained in step (i) at least to either (a) a temperature of not less than a melting point of the obtained mixture of components (i) and (ii) in step (I) or (b) a temperature not less than a melting point of a component having the highest melting point of components (i) and (ii) in step (i) capable of neutralizing said acid precursor of the anionic surfactant in an agitating mixture thereby forming a gelled product containing said nonionic surfactant, and granulating said gelled product which acts as a binder while tumbling the agitating mixture at either of said temperatures thereby increasing a bulk density, to give nonionic detergent granules having a bulk density of from 0.6 to 1.2 g/ml.

2. The method according to claim 1, wherein said nonionic surfactant is a polyoxyethylene alkyl ether which is an ethylene oxide adduct with an average molar number of from 5 to 15 of a linear or branched, primary or secondary alcohol having 10 to 20 carbon atoms.

3. The method according to claim 1, wherein said aqueous nonionic surfactant solution is an aqueous solution of a polyoxyethylene alkyl ether, the polyoxyethylene alkyl ether being an ethylene oxide adduct with an average molar number of from 5 to 15 of a-linear or branched, primary or secondary alcohol having 10 to 20 carbon atoms, wherein the water content of the aqueous nonionic surfactant solution is not more than 15% by weight.

4. The method according to claim 1 wherein said acid precursor is present in an amount of 10 to 60 parts by weight based on 100 parts by weight of at least one of the nonionic surfactant and the aqueous nonionic surfactant solution.

5. The method according to claim 1, wherein the amount of said acid precursor of the anionic surfactant capable of having a lamellar orientation is from 15 to 50 parts by weight, based on 100 parts by weight of the amount of at least one of said nonionic surfactant and said aqueous nonionic surfactant solution.

6. The method according to claim 1, wherein said alkali builder is selected from the group consisting of organic or inorganic powdery builders, each having a pH of not less than 8 when prepared as an aqueous solution or a dispersed solution, at 20° C. with a concentration of 1 g/liter.

7. The method according to claim 6, wherein said alkali builder is one or more compounds selected from the group consisting of tripolyphosphates, carbonates, bicarbonates, sulfites, silicates, crystalline aluminosilicates, citrates, polyacrylates, salts of copolymers of acrylic acid and maleic acid, and polyglyoxylates, each having an average particle size of not more than 500 μm.

8. The method according to claim 1, wherein said alkali, porous oil-absorbing carrier has the following properties:

(a) Having a pH of not less than 8 when prepared as an aqueous solution or a dispersed solution, at 20° C. with a concentration of 1 g/liter;

(b) Having a microporous capacity measured by a mercury porosimeter of from 100 to 600 $cm^3$/100 g;

(c) Having a specific surface area according to BET method of from 20 to 700 $m^2$/g; and (d) Having an oil-absorbing capacity according to JIS K 5101 of not less than 100 ml/100 g, said alkali, porous oil-absorbing carrier having an average particle size or an average primary particle size of not more than 10 μm.

9. The method according to claim 8, wherein said alkali, porous oil-absorbing carrier is one or more compounds selected from the group consisting of amorphous aluminosilicates and calcium silicates, with an average primary particle size of not more than 10 μm.

10. The method according to claim 9, wherein said alkali, porous oil-absorbing carrier is an amorphous aluminosilicate having a water content of 15 to 30% by weight, with an average primary particle size of not more than 0.1 μm, and an average particle size of agglomerates thereof of not more than 50 μm.

11. The method according to claim 1, wherein step (I) is carried out by using a mixed solution obtained by mixing at least one of said nonionic surfactant and said aqueous nonionic surfactant solution with said acid precursor of the anionic surfactant capable of having a lamellar orientation; and subsequently step (II) is carried out by heating to a temperature of not less than a melting point of the obtained mixture of components (i) and (ii) in step (I).

12. The method according to claim 1, wherein step (I) is carried out by adding at least one of said nonionic surfactant and said aqueous nonionic surfactant solution, and said acid precursor of the anionic surfactant capable of having a lamellar orientation without mixing in advance; and subsequently step (II) is carried out by heating to a temperature of not less than a melting point of a component having the highest melting point of components (i) and (ii) in step (I).

13. The method according to claim 1, wherein at least one of a neutral or acidic builder and spray-dried particles thereof is further added at any stage in step (I).

14. The method according to claim 13, wherein said neutral or acidic builder is selected from the group consisting of organic or inorganic builders having a pH of less than 8 when prepared as an aqueous solution or a dispersed solution, at 20° C. with a concentration of 1 g/liter.

15. The method according to claim 14, wherein said neutral or acidic builder is one or more compounds selected from the group consisting of sodium sulfate, citric acid, polyacrylic acids, partially neutralized polyacrylic acids, copolymers of acrylic acid and maleic acid, and partially neutralized copolymers of acrylic acid and maleic acid.

16. The method according to claim 13, wherein said spray-dried particles are particles obtained by spray-drying a water slurry containing one or more organic or inorganic builders.

17. The method according to claim 16, wherein said spray-dried particles are particles obtained by spray-drying a slurry containing one or more compounds selected from the group consisting of carbonates, crystalline aluminosilicates, citrates, sodium sulfate, sulfites, polyacrylates, salts of copolymers of acrylic acid and maleic acid, polyglyoxylates, anionic surfactants, nonionic surfactants, and fluorescent dyes.

18. The method according to claim 1, wherein the amount of the detergent starting materials used in step (i) is selected from the following composition (a) or (b):

(a) 10 to 60 parts by weight in a total amount of at least one of said nonionic surfactant and said aqueous nonionic surfactant solution, and said acid precursor of the anionic surfactant capable of having a lamellar orientation; 40 to 90 parts by weight of at least one of said alkali builder and said alkali, porous oil-absorbing carrier; and 0 to 10 parts by weight of said neutral or acidic builder;

(b) 10 to 60 parts by weight in a total amount of at least one of said nonionic surfactant and said aqueous nonionic surfactant solution, and said acid precursor of the anionic surfactant capable of having a lamellar orientation; 10 to 80 parts by weight of at least one of said alkali builder and said alkali, porous oil-absorbing carrier; 0 to 10 parts by weight of said neutral or acidic builder; and 10 to 80 parts by weight of said spray-dried particles.

19. The method according to claim 1, wherein step (II) is carried out using an agitating mixer equipped with a jacket capable of flowing warm water therein, the temperature of the warm water flowing in the jacket being set at a temperature higher than (A) or (B) defined below:

(A) A melting point of the following mixed solution, in a case where step (I) is carried out by using a mixed solution obtained by mixing at least one of said nonionic surfactant and said aqueous nonionic surfactant solution with said acid precursor of the anionic surfactant capable of having a lamellar orientation;

(B) A melting point of the following compound having the highest melting point among the following components, in a case where step (i) is carried out by adding at least one of said nonionic surfactant and said aqueous nonionic surfactant solution, and said acid precursor of the anionic surfactant capable of having a lamellar orientation without mixing in advance.

20. The method according to claim 19, wherein the granulation process of step (II) is carried out in an agitating mixer comprising an agitating shaft along a center line of the horizontal cylinder and agitating impellers arranged in said agitating shaft.

21. The method according to claim 20, wherein the granulation process is carried out under the condition of a Froude number of from 1 to 4, based on the rotation of the agitating impellers arranged in the agitating mixer used in step (II).

22. The method according to claim 19, wherein said granulation process in step (II) is carried out for 2 to 20 minutes.

23. The method according to claim 1, wherein step (I) and step (II) are carried out in the same mixer.

24. The method according to claim 1, further comprising mixing the granulated product obtained in step (II) and fine powder, to thereby coat surfaces of the granulated product with fine powder having an average particle size of not more than 10 μm.

25. The method according to claim 24, wherein the amount of said fine powder used is from 0.5 to 20 parts by weight, based on 100 parts by weight of said granulated product.

26. The method according to claim 25, wherein said fine powder is one or more compounds selected from the group consisting of crystalline or amorphous aluminosilicates, and calcium silicates.

27. The method according to claim 1, wherein the obtainable nonionic detergent granules have an average particle size of from 250 to 800 μm.

28. The method according to claim 1, wherein said obtainable nonionic detergent granules have a fluidity property with a flow time of not more than 10 seconds, the flow time being a time period required for dropping 100 ml of powder from a hopper used in a measurement of bulk density according to JIS K 3362.

29. The method according to claim 1, wherein said obtainable nonionic detergent granules have a caking property with a sieve permeability of not less than 90%.

* * * * *